United States Patent [19]

Zamboni

[11] 4,356,584

[45] Nov. 2, 1982

[54] APPARATUS FOR REMOVING WATER FROM LARGE SURFACE AREAS

[75] Inventor: Richard F. Zamboni, Huntington Beach, Calif.

[73] Assignee: Frank J. Zamboni & Co., Paramount, Calif.

[21] Appl. No.: 172,167

[22] Filed: Jul. 25, 1980

[51] Int. Cl.[3] ..... A47L 11/00

[52] U.S. Cl. ..... 15/98; 15/3; 404/124

[58] Field of Search ..... 15/1, 3, 97 R, 98, 230.11, 15/320, 352, 340, 405; 404/123, 125, 124

[56] References Cited

U.S. PATENT DOCUMENTS

| | | | |
|---|---|---|---|
| 374,117 | 11/1887 | Derby | 404/125 |
| 3,233,530 | 2/1966 | Brebner | 404/124 |
| 3,351,971 | 11/1967 | Hocking et al. | 15/340 |
| 3,683,447 | 8/1972 | Stevenson | 15/320 |
| 3,736,619 | 6/1973 | Zamboni | 15/340 |
| 3,967,339 | 7/1976 | Newman | 15/98 |

*Primary Examiner*—Edward L. Roberts

*Attorney, Agent, or Firm*—K. H. Boswell; Edward D. O'Brian

[57] ABSTRACT

An apparatus for removing standing water from a large surface area includes a housing capable of being moved across the surface area. An elongated rolling member is mounted on the housing with its elongated axis transverse to the direction of travel of said housing over the surface area. At least a portion of the rolling member is located on the underneath side of the housing. The rolling member has a nonwater absorbing wear resistant surface enabling that portion of it located below the housing to contact the surface area to be depleted of water. The rolling member rolls on the surface area to displace water to a position in front of the rolling member and form a moving wave of water in front of the rolling member. A wave direction changing member is located in association with the rolling member in front of the rolling member. The wave direction changing member imparts a momentum to the wave of water maintaining the wave of water on the underside of the housing. A component of the momentum imparted to the wave of water is directed transverse to the direction of travel of the housing towards one or the other of the ends of the rolling member.

15 Claims, 10 Drawing Figures

APPARATUS FOR REMOVING WATER FROM LARGE SURFACE AREAS

BACKGROUND OF THE INVENTION

This invention is directed to an apparatus for removing water off of a surface of a large surface area such as a race track, a runway or the like. The apparatus includes a rolling member which piles up a wave of water in front of it as it moves and a wave direction changing member which is capable of imparting a momentum to the wave, at least a portion of said momentum directed to one of the ends of the rolling member to cause the wave of water to be displaced toward the end of the rolling member.

The pooling or improper drainage of water on certain surface areas such as race tracks and airport runways can be hazardous because of the loss of traction between a vehicle's tires and the surfaces.

In certain sporting events such as baseball and football played on artificial turf, standing water also presents a problem. Machines have been invented which are capable of removing water from artificial turf. Examples can be found in U.S. Pat. Nos. 3,683,447; 3,351,971; 3,736,619; and 3,835,500. For other sporting events such as tennis and for factory floors and the like, a different class of water removal apparatus is known. Included in this class would be a machine known under the tradename of the "WATER BLOTTER" and the long handled rollers, e.g. U.S. Pat. No. 3,967,339. In addition to these machines, a machine is also known for removing painted stripes from artificial turf. This machine is described in U.S. Pat. 4,069,540.

The machines used for water removal on artificial turf generally have a vacuum chamber associated with a roller. The roller squishes down on the turf to squeeze or displace water from the turf and this water is then removed from the turf by a large mechanical vacuum apparatus. Generally the water is stored in tanks which are periodically drained or as is described in the U.S. Pat. No. 3,683,447 noted above, the water is blown to the side of the artificial surface through a nozzle under pressure. While these machines are useful for the artificial of athletic fields and the like, they are not practical to use on race tracks and runways. This is because of several reasons.

Race tracks and runways are of a much greater surface area and therefore the machines that rely on storage tanks to receive the "vacuumed up water" are limited to the capacity of the storage tank. Use of such a machine on a large surface area would require repetitive trips to a dumping sight to empty the storage tanks. Further these types of machines also require a vacuum system. The vacuum system has several inherent disadvantages. It requires a sizable power plant to generate the necessary vacuum power which thus requires expenditures of large amounts of fuel. Further, a pump or some other type of apparatus is necessary to achieve the vacuum. Any pump, turbine or the like is susceptible to exceedingly fast wear, if not catestrophic failure, by the presence of particles of sand, small rocks and the like which are normally found on the surface of race tracks, runways, etc. Additionally these devices generally need to first compress the artificial turf to squeeze the water from it so that it may be vacuumed up. This action, of course, is impossible on hard surfaces such as concrete, asphalt and the like.

Machines such as the water blotter and the long handled roller find certain utility on small surface areas such as tennis courts. The water blotter, like the above noted artificial turf machines, utilizes a storage tank so that the water picked up by its foam surface roller can be transferred to the tank for temporary storage. As noted, storage tanks are impractical for large surface areas and additionally rollers having foam-like surfaces are subject to extreme wear and thus short life when exposed to abrasive surfaces such as concretes, asphalts and the like. Roller-like devices such as that described in the U.S. Pat. No. 3,967,339 require manual pushing and thus would be of little utility for any kind of large surface area.

Solid debris such as dirt, rocks and sand are easily moved over large surface areas through the use of mechanical devices having plows attached thereto. These plows are normally made of a ferrous metal to resist wear. Such a plow would not be useful for water removal, however, in that some type of seal must be made between the water removing machine and the surface area. This is, of course, impossible between a metal plow and a hard surface area which generally is not perfectly smooth, for example, an asphalt race track. It is conceivable that a plow, in effect a giant squeegee, could be formed of a rubber-like material. This would serve to form the necessary seal between the plow and the surface area without being detremental to the surface area itself, but such a squeegee-like plow would be of short life and therefore essentially useless. The friction in dragging such a large squeegee-like plow against a hard surface would very soon wear the rubber material off to a point where the squeegee-like plow would be useless.

BRIEF SUMMARY OF THE INVENTION

Because of safety factors it is desirable to be able to remove standing water from large surface areas. As the above discussion points out, however, at present, there exists no machine or device which is capable of doing this. It is therefore a broad object of this invention to provide an apparatus which is capable of removing water from large surface areas. It is a further object of this invention to provide an apparatus which is capable of removing water from large surface areas. It is a further object of this invention to provide such an apparatus which can perform this water removing function in a minimum amount of time with a minimum expenditure of equipment used and energy. It is a further object of this invention to provide an apparatus which because of its simplicity contains few moving parts which are subject to wear and thus malfunction.

These and other objects as will become evident from the remainder of this specification are achieved by providing an apparatus for removing standing water from a large surface area which comprises: a housing capable of being moved across said surface area; an elongated rolling means rotatably mounted on said housing with the elongated axis of said rolling means transverse to the direction of movement of said housing on said surface area and including at least a portion of said rolling means located on the underside of said housing, said roller means having an essentially nonwater absorbant, wear resistant surface, said portion of said rolling means located on the underside of said housing contacting a portion of said surface area and rolling on said surface area as said housing moves across said surface area, said rolling means capable of displacing water on said surface area to a position in front of said rolling means and in doing so imparting a momentum to said water and forming a moving wave of water in front of said rolling means as said rolling means moves across said surface area; wave direction changing means located on the underside of said housing in front, with respect to the direction of travel of said housing, of said portion of said rolling means located on the underside of said housing and associated with at least that portion of said rolling means located on the underside of said housing, said wave direction changing means capable of interaction with said wave of water to modify the momentum of at least a portion of said wave of water, said modified momentum of said wave of water maintaining said wave of water essentially below the underside of said housing, at least a component of of said modified momentum of said wave of water being directed transverse to the direction of travel of said housing toward at least one of the ends of said rolling means.

Preferredly the wave direction changing means includes a member statically located in front of the roller means. This member is capable of incremental interaction with the wave or portions thereof to impart the component of the momentum which is transverse to the direction of travel of the housing or coaxial with the elongated axis of the rolling means. Preferably this member includes a plurality of fixed plates or vanes which are bent such that as the wave moves along the plate its direction of travel is modified because of the bend.

Alternately the wave direction changing means could include means for dispensing a fluid under pressure greater than atmospheric pressure. Such pressurized fluid would be directed toward the wave to interact with the wave in a manner imparting momentum to it.

Additionally a spray collection means can be located behind the rolling means such that it is positioned to interact with droplets or spray of water lifted upwardly and backwardly by the rolling motion of the rolling means. The spray collection means is capable of collecting the droplets or spray and channeling them both downwardly and towards one of the ends of the rolling means. Preferably the spray collection means is a baffle means which assists in collecting the spray and droplets by inhibiting deflection back towards the rolling means.

The apparatus can also be augmented by including at least one wheel attached to the housing which assists in moving the housing when the rolling means is not contacting a surface area, but which is capable of being displaced to a position allowing the rolling means to contact the surface area during actual water removal. Also an air foil means can be located on the housing which assists in contact of the rolling means on the surface area by providing a downward directed force resulting from interaction of the air foil means with air as the housing is moved.

In an alternate form of the invention at least two independent rolling means are located in a tandem fashion, one behind the other, but are displaced transversely with respect to one another. The end of the leading roller means with respect to the roller means behind it is positioned between one of the ends of the roller means and the center of the roller means such that the wave of water exiting off of the leading roller means is directed to the same side, with respect to the center of the housing, on the tailing roller means. If three or more roller means are used the rollers are positioned in an echelon. One or more of the roller means in this embodiment can be equipped with a wave changing direction means noted above. However, if so equipped the direction of the momentum imparted to the wave of water has to coincide with the direction of stepping of the echelon of roller means.

BRIEF DESCRIPTION OF THE DRAWINGS

The invention described in this specification will be better understood when taken in conjunction with the drawings wherein.

Figure 1:
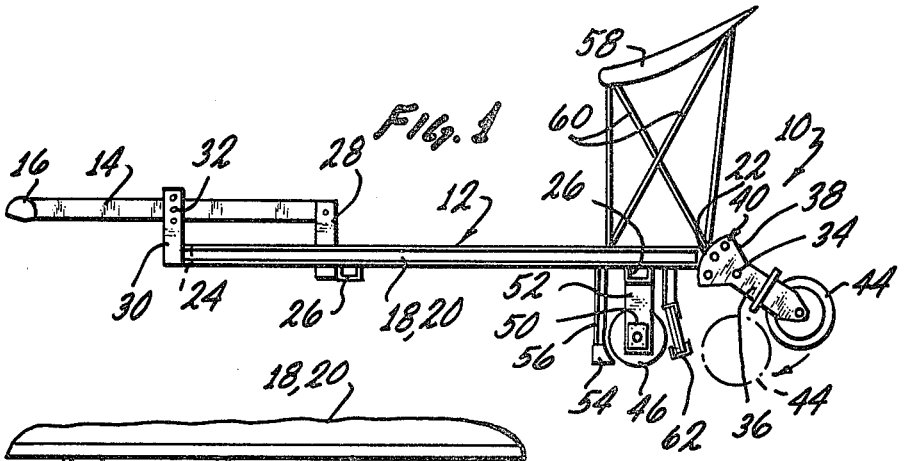
FIG. 1 is a side elevational view of a first embodiment of the invention.

The invention described in this specification and illustrated in the drawings utilizes certain principles and/or concepts that are set forth in the claims appended to this specification. Those skilled in the art to which this invention pertains will realize that these principles and/or concepts could be utilized in a number of embodiments differing from the precise embodiments herein illustrated. For this reason this invention is to be construed in light of the claims and is not to be construed as being limited to the exact embodiments herein illustrated.

DETAILED DESCRIPTION

All of the embodiments herein described for this invention will be shown as being attached to a trailer-like housing which is capable of being coupled to a drive vehicle such as a car or truck, for propelling the invention across a large surface wherein standing water is located. It will be understood, of course, that this invention is susceptible to being mounted on a self-propelled vehicle. It is considered, however, that the invention will find its greatest utility coupled with minimum manufacturing expense and thus purchase price when the invention is mounted on a towable housing or trailer.

Figure 6:
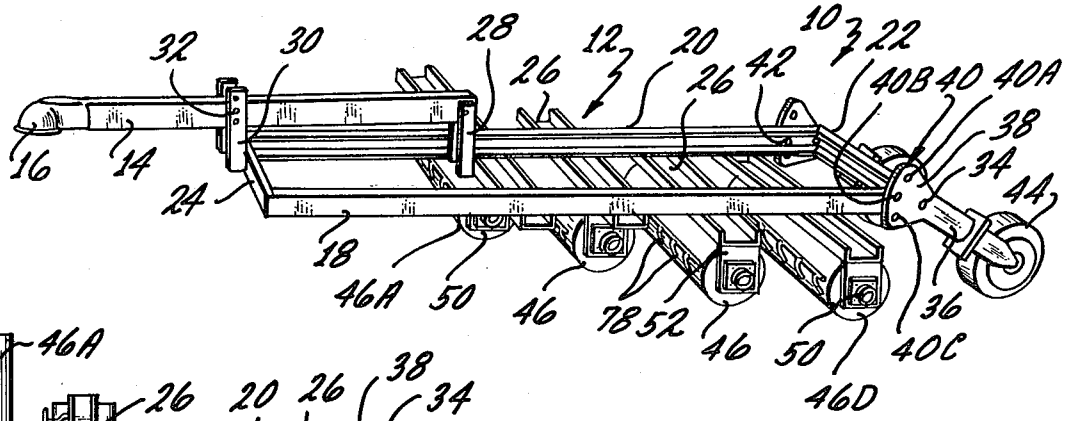
FIG. 6 is an isometric view of an alternate embodiment of the invention.
Figure 9:
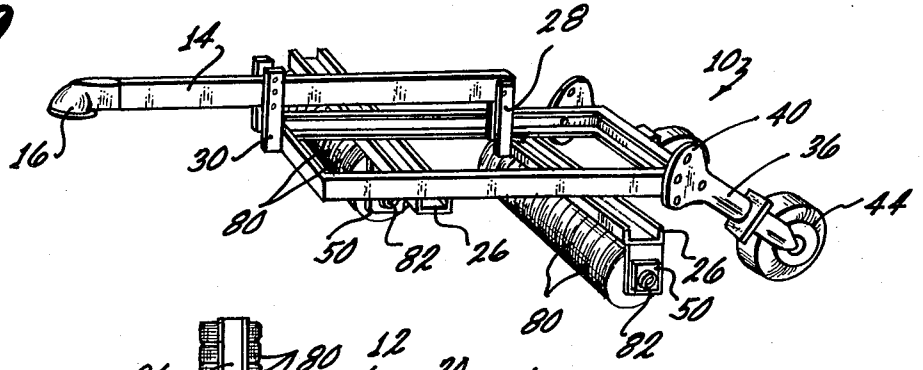
FIG. 9 is an isometric view of an alternate embodiment of the invention.

In FIGS. 1 and 9 a shortened version of the trailer is shown while FIG. 6 illustrates a longer version. Since aside from their lengths and components attached thereto, as hereinafter explained, these trailers are equivalent and therefore like numerals will be used to describe like components thereof.

The water removing apparatus 10 includes a trailer or housing 12. Extending from the forward end of the trailer is a tongue 14. The tongue has a typical receiving hitch 16 adapted to receive a ball hitch (not numbered or shown) mounted on the driving vehicle.

The trailer 12 includes a right and left lateral member 18 and 20 and a fore and aft transverse member 22 and 24 respectively. These are appropriately welded together to form a rectangular shaped structure. Depending upon the embodiment which is being utilized one or more cross beams 26 are connected to the right and left lateral members 18 and 20. An upright channel member 28 extends from the most forward of these cross members 26 and the tongue 14 is pivotally attached to this member. An upright member 30 extends upwardly from the fore transverse member 22.

The member 30 has a right and a left parallel upright (not individually numbered) each having a plurality of aligned holes (not numbered) in their surfaces. A pin 32 goes through these holes and through an aligning hole (not seen or numbered) in tongue 14. This allows the tongue 14 to be adjusted to several levels or heights to accomodate potential differences in heights of vehicles which will pull the trailer 12. As will be evident from the remainder of this specification, in the embodiment shown in FIGS. 6 and 8 it is necessary for the trailer 12 to be somewhat level. Therefore by providing the member 30 with a plurality of holes, a very quick and easy adjustment can be made to facilitate leveling of the trailer 12 with respect to components located thereon and with respect to the height of the ball hitch which connects with the receiving hitch 16.

Pivotally mounted to the rear of the trailer 12 by pins 34 are two wheel brackets collectively identified by the numeral 36. These brackets have a sector 38 located on their upper end. Each of the sectors 38 contains a plurality of holes collectively identified by the numeral 40 located in an arc which is centered about pin 34. A matching hole 42 is located in both the right and left lateral members 18 and 20. The wheel brackets 36 can therefore be held in a plurality of positions with respect to the right and left lateral members 18 and 20 by appropriately inserting the pin 34 through one of the plurality of holes 40 into the hole 42.

On the other end of each of the wheel brackets 36 is a wheel 44. The wheels 44 are appropriately journaled to the wheel brackets 36 such that they are free to rotate. Depending upon the position of the wheel brackets 36, i.e. which of the holes 40 the pin 34 is located in, the wheels 44 may or may not be positioned to contact the ground. When the pin 34 is located in hole 40A the wheels contact the ground and other components hereinafter described are lifted up from the ground. When the pin 34 is located in one of the other holes such as hole 40C the wheels 44 no longer contact the ground, but instead the trailer 12 rests on other components as hereinafter explained. Together the wheels 44 and the receiving hitch 16 provide for a three-point suspension of the trailer 12 to facilitate moving the same when the water removal apparatus is not actually being used to remove water.

Referring now to the embodiment described in FIGS. 1 through 5, mounted below the cross member 26 is roller 46. Roller 46 is rotatably mounted via an axle 48 which fits into appropriate bearings 50 which are located on vertical attaching plates 52 appropriately attached to the right and left hand side of cross member 26. Normally the vertical attaching plates 52, the cross member 26 and the members 18, 20, 22 and 24 would be welded into a unified structure from appropriate ferrous metals.

In the figures the roller 46 is shown in a position wherein it is located in its entirety on the underside of the trailer 12. This would be a preferred position, however, in other embodiments the roller 46 could be so attached to the trailer 12 that only a portion of it extends on the underside of the trailer 12. It is preferred, however, to select the diameter of roller 46 such that the totality of the roller 46 is located below the trailer 12. The diameter of the roller 46 as well as the height of the trailer 12 above the surface are variable and these dimensions will be governed by factors such as the type of vehicle which is used to tow the trailer 12 and the size and type of surface from which the water will be removed.

The roller 46 is preferredly a unifying elongated cylindrical roller. It could be formed as a solid monolithic unit of a suitable material as hereinafter described or it could be formed as either a hollow or a solid structure of a first component having an outer skin surface of a material similar or identical to the material used in the previously noted monolithic structure. Alternately the roller 46 could be composed of a plurality of individual rollers which are arranged axially across the width of the roller 46 to form either a composite unified structure of a unitized structure. The unitized structure will be explained hereinafter, however, for the purposes of most of this specification roller 46 will be considered to be an elongated, cylindrical, unified monolithic body.

The material chosen for the roller 46 (or for a surface covering thereof) would be an essentially nonwater absorbant, wear resistant material. Suitable would be materials such as hard polymers for example, rubbers, urethanes and the like. By essentially nonwater absorbing it is meant that the material for roller 46 will not act like a sponge. That is, this material preferably does not contain interconnected pores or cavities which are capable of absorbing water by capillary action or other transfer mechanism and retaining this water. The material for roller 46 could exhibit some degree of flexibility. By this it is meant that it would be possible to indent the surface of the roller 46 to a small degree such as by contact with a small pebble or the like. While a material such as steel fits the category of a nonwater absorbant, wear resistant surface, in the preferred embodiment of this invention it is not contemplated to use this type of material. Such a material would not have the ability to deflect slightly upon contact with a small pebble. A solid nondeflecting roller made of steel when contacting a pebble would be lifted above the surface upon which it is rolling as it traveled over the pebble and thus would break the continuity between the surface of the roller 46 and the surface from which water is being removed and would allow seepage of water between these two and to a position behind the roller 46.

Preferredly the outside cylindrical surface of the roller 46 will be smooth allowing for continuous contact along the elongated length of the roller between the roller and the surface it is rolling on. Deviation from this smooth surface in an alternate unitized embodiment is discussed hereinafter.

The roller 46 is appropriately mounted on axle 48 such that axle 48 is aligned perpendicular or transverse to the axis of travel of the trailer 12. This allows roller 46 to be freewheeling about bearing 50. Because of the preferred material described above which is utilized in roller 46 it is preferable to minimize friction between the roller 46 and the ground. Any such friction, of course, would contribute to the wear of roller 46 and thus shorten its useful life. The perpendicular alignment as described above with respect to the direction of travel of the trailer 12 minimizes friction between it and the ground. If roller 46 were, in fact, not so perpendicularly aligned, but instead was aligned at an angle, friction between the roller 46 and the ground would be created along the vector which is coaxial with the direction of travel of the trailer 12.

The weight of the trailer 12, the roller 46 and the other components attaching to the trailer 12 causes the roller 46 to be depressed against the surface on which it is rolling a sufficient amount to form a limited water seal between the roller 46 and the surface it is rolling on. Because of this fact, as the trailer 12 is propelled forward, the roller 46 rolls upon the surface it is riding on and any water located on that surface is maintained, at least to a significant degree, in front of the roller 46. This water is piled up to form a wave which moves in front of the roller 46. The extent of the amount of water which can be incorporated in this wave is, of course, limited by several factors. The first of these is that as the height of the wave builds up, since the roller has no restrictions on its ends, the wave will, under its own hydrostatic pressure, disperse in all directions. Secondly, as the height of the wave builds up the hydrostatic pressure of the wave in front of the roller influences the seal between the roller 46 and the surface wherein the water is located. The greater the height of the wave the more likely that it is to break through this seal and flow to the rear of the roller. Of course, the height of the wave can be no greater than the diameter of the roller since then the wave would flow over the roller.

This forward momentum of the roller also imparts a forward momentum to the wave. This forward momentum counteracts the hydrostatic dispersion and seal breakage noted above, but additionally, as is explained subsequently, at least a component of this forward momentum of the wave is redirected such that the wave is given a component of momentum directed to one or the other ends of the roller. This causes the wave to be displaced sideways toward one or the other of the ends of the roller and eventually causes the wave to spill over one of the ends of the roller. The net effect is, of course, that water has been displaced from an area equal to the width of the roller to one or the other side of the roller.

Figure 2:
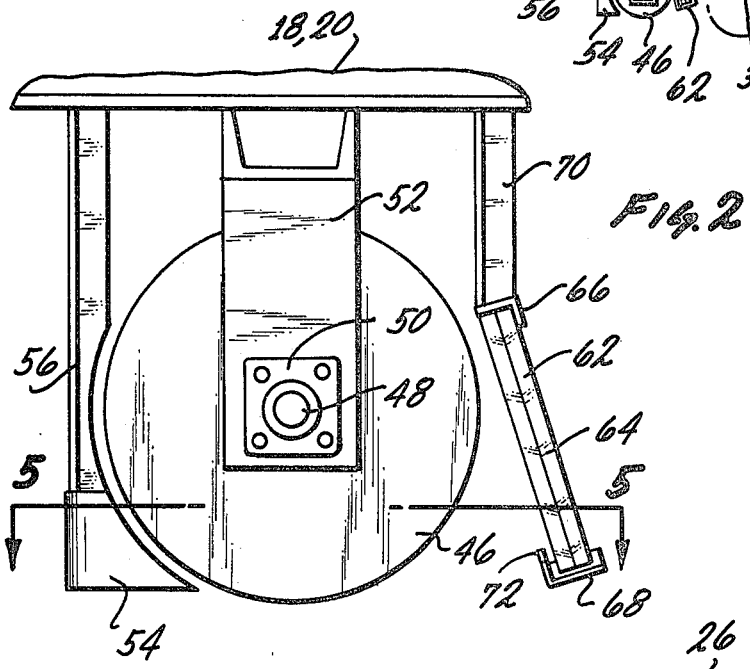
FIG. 2 is a side elevational view of a section of FIG. 1 showing that section in greater detail.
Figure 3:
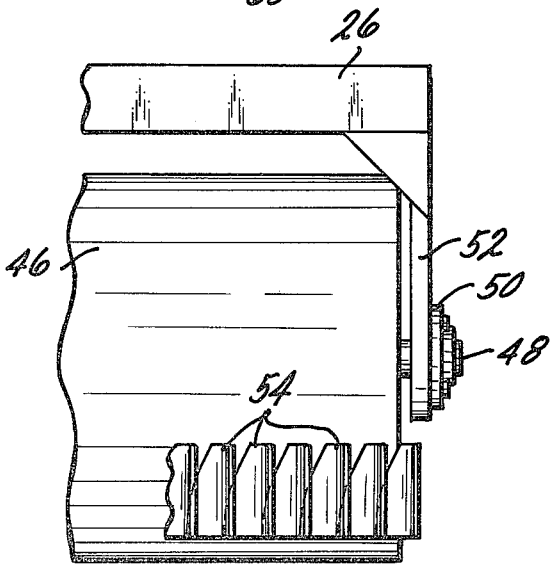
FIG. 3 is a front elevational view of the section shown in FIG. 2.
Figure 4:
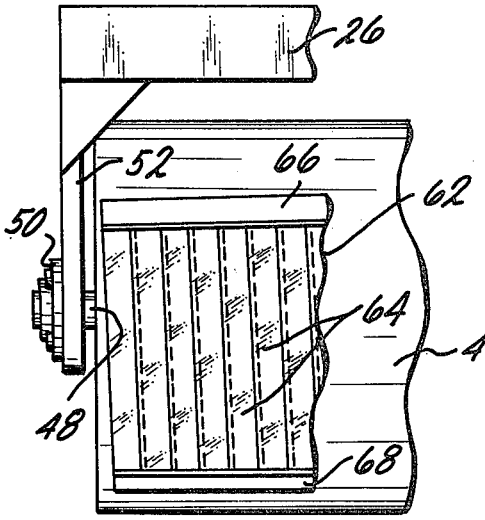
FIG. 4 is a rear elevational view of the section shown in FIG. 2.

The wave direction changing means depicted in FIGS. 1, 2 and 3 consists of a plurality of plates or vanes 54 spaced along the length of the roller 46 directly in front of it with respect to the direction of travel of the trailer 12. Preferably each of the vanes 54 are contoured as is shown in FIG. 2 to mimic the circular perimeter of the roller 46. This allows these vanes 54 to be placed in almost an abutting alignment with the roller 46.

Figure 5:
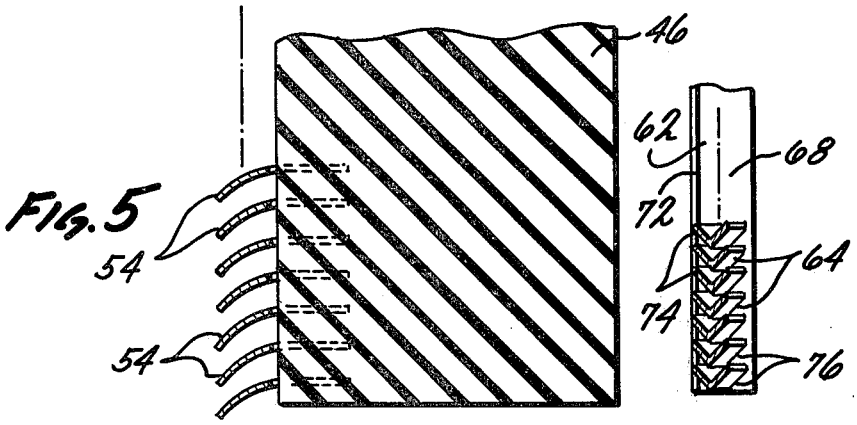
FIG. 5 is a plan view in section about the line 5—5 of FIG. 2.

The vanes 54, as viewed in FIGS. 3 and 5, are curved. This curve bends from the surface of the roller 46 towards one of the ends of the roller 46. That is the vanes 54 adjacent to the roller 46 are aligned almost in line with the direction of movement of the trailer 12 and then they curve toward an alignment which is about 45° from either the direction of movement of the trailer 12 or the axial axis of the roller.

Each of the individual vanes 54 is fixedly attached to the vane holding plate 56 which in turn is fixedly attached to the right and left lateral members 18 and 20 of the trailer 12. The vanes 54 are located directly in front of the roller 46 in the position wherein the wave is also formed. As the wave is formed in front of the roller 46 it is in continued contact with the vanes 54. The vanes 54 continually impart a component of momentum to this wave which is directed toward one of the ends of the roller 46. It is preferred that all of the vanes are shaped exactly the same way so that a wave of water is directed to only one of the ends of the roller 46. In use then the trailer 12 could be continually pulled in a spiral pattern around a race track and the water around the race track would be continually pushed toward the same edge of the race track with each successive pass of the apparatus 10.

To increase the downward pressure of the water apparatus 10 along the edge of the roller 46 which contacts the surface from which water is being removed, an air foil 58 can be mounted on the upper surface of the trailer 12. The air foil 58 is appropriately supported by brackets collectively identified by the numeral 60 which positions it such that it is in line to be contacted by air as the trailer 12 is pulled. In the preferred embodiment wherein the water apparatus 10 is not self-propelled, but in fact, is pulled by another vehicle, the bracket 60 lifts the air foil 58 a sufficient height such that it can contact the air moving off of the back of the propelling vehicle. As the trailer 12 is towed faster and faster the more susceptible the roller 46 will be to hydroplaning. By including an air foil 58 a greater degree of pressure will be directed downwardly on the roller 46 the faster the speed of the trailer 12. The air foil 58 therefore, finds its greatest utility in those situations where the trailer 12 is pulled at a rapid speed.

A spray collection apparatus 62 can be located to the rear of, with respect to the direction of travel, of the roller 46. Even though the majority of the water contacted by the roller 46 is maintained in front of the roller 46 as the wave, a portion of this water will wet and adhere to the surface of the roller 46. Because of the rapid rotation of the roller 46 this adhering water can be discharged under the influence of centrifugal force behind the roller 46 as it rotates.

Normally the discharged water will be discharged in the form of a spray, however, larger units of water such as droplets can also be formed. In the apparatus illustrated in FIG. 1 wherein only one roller is used the spray collectin unit 62, of course, will be positioned directly behind this one roller. In the embodiment illustrated in FIGS. 6 and 8, even though the spray collection apparatus 62 is not illustrated in this figure, it could be appropriately placed behind the rearmost roller 46D. The other rollers in front of roller 46D would tend to discharge the majority of their spray or droplets directly against the roller behind them. This would tend to inhibit dispersal of the droplets or spray.

Figure 8:
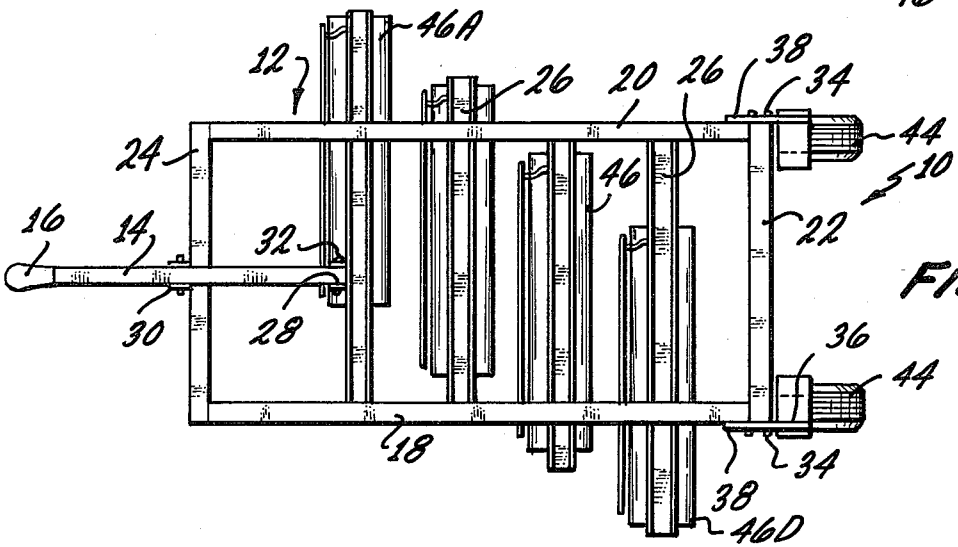
FIG. 8 is a top plan view of the embodiment of FIG. 6.

For the multiple roller embodiment illustrated in FIGS. 6 and 8 further control of spray or droplets dispersion could be achieved by placing a continuous surface over the body of the trailer 12 immediately above the rollers 46. In this manner any spray or droplet could not be flipped upwardly above the trailer 12 between the individual rollers 46. Additionally, in this embodiment a portion of each roller is exposed to one side with respect to the roller directly behind it. Spray or droplets ejected from this portion would not contact a subsequent roller. In this embodiment, then a spray collection apparatus 62 which is only as wide as the portion of a leading roller which extends beyond the tailing roller could be utilized. Thus each of the exposed or extended portions of the rollers 46 located on the far side of FIGS. 6 and 8 could include a short segment of the spray collecting apparatus 62.

The spray collecting apparatus 62, whether it be across the whole roller 46 or only a partial segment of it as discussed in the preceding paragraph, would be constructed as follows.

A series of angled baffles 64 are arranged each individually slightly askew vertically but collectively lying in the same plane. They are fixedly attached to upper mounting brackets 66 and to lower mounting brackets 68. The upper mounting bracket 66 is attached to a bracket 70 which is fixed to the right and left lateral members 18 and 20 thus positioning the individual baffles 64 beneath the trailer 12. The spray collecting apparatus 62 is positioned behind the roller 46 directly in line with the pathway taken by droplets or spray being propelled off of the surface of roller 46 as is best seen in FIG. 2.

As noted in the previous paragraph the individual baffles are individually placed such that they are slightly askew from a perfect vertical orientation. This allows water collected on their surface to descend down the surface against the surface of the baffle wetting the surface of the baffle. As the surface of the baffle becomes wet this augments the function of the baffle. Additional droplets or spray striking this surface immediately adhere to it and show no tendency to deflect off of the surface.

The lower mounting bracket 68 is slanted downwardly toward the side wherein the wave of water is directed by the vanes 54. As can be seen in FIG. 2 the lower mounting bracket is essentially L-shaped and has a wall 72 on one end, its high end, which inhibits dispensing of water off of that end. Water is thus channeled toward the low end and is dispensed from the lower mounting bracket 68 at that end of the roller 64 wherein that wave of water is also directed.

As seen in FIG. 5 in cross section the individual baffles 64 are angled at approximately a right angle thus they can be essentially described as having a very wide spread V-shape in cross section. They are oriented with respect to one another and with respect to the roller 46 as is seen in FIG. 5. This presents a tortuous channel between the surface of the roller 46 and the back side of the spray collecting apparatus 62. Any spray or droplet to completely find its way through the spray collecting apparatus 62 would have to travel a pathway having an angle midway. Because of the positioning of the spray collecting apparatus 62 directly behind the roller 46 very little air flow occurs between the individual baffles 64 thus the individual water droplets or spray cannot be carried by air currents through the tortuous channels between the baffles 64. The majority of the spray or droplets strike and are collected on the front arm 74 of the baffle 64. That which escapes the front arm 74 is collected on the back arm 76. Any droplets or spray impinging on either of these arms will be deflected or reflected into an adjacent arm and will not be deflected or reflected either back toward the roller 46 or away from the roller 46.

An alternate form of the invention as above described is seen in FIGS. 6 and 8. As previously noted in these figures there are a plurality of rollers 46. Each of these rollers are spaced in an echelon, one in front of the other, in a stepwise manner. If the plurality of rollers 46 shown in FIGS. 6 and 8 are not equipped with vanes 54 the wave of water could be dispersed by hydrostatic pressure towards both of the ends of the individual rollers.

In order to overcome the tendency of water to spill out of both ends of the rollers 46 and thus detract from the efficiency of the water collection apparatus 10, the rollers are located one behind the other with the end of a leading roller located quite close to the end of the roller directly behind it. The one end of the leading roller would be positioned at least between one end of and the center of a tailing roller but more preferably the end of the leading roller would even be closer to the end than the midpoint. Normally the end of the leading roller would be only positioned about twenty-five percent of the total length of the tailing roller away from the end of the tailing roller. As seen in FIG. 8 this results in a twenty-five percent overlap between the front and rear roller even though four rollers are used.

The arrangement of a leading and tailing roller as described in the preceding paragraph could be described as stacking the rollers in a stepwise manner. Since water dispersed off of the end of the leading roller strikes the tailing roller very close to its end this water will tend to go off of the end of the tailing roller which is on the same side as the end of the leading roller from which the water was originally dispensed. The last roller with respect to the direction of travel, would then essentially contact water only near one of its ends along about twenty-five percent of its surface. This, however, is without the use of the vanes 54. When the vanes 54 are in place, at least on the front roller, and preferably on all of the rollers, water is almost exclusively directed toward the side of the water removing apparatus 10 wherein the last roller jets out from, i.e. the side toward the observer of FIG. 6 and the lower side in FIG. 8.

Figure 7:
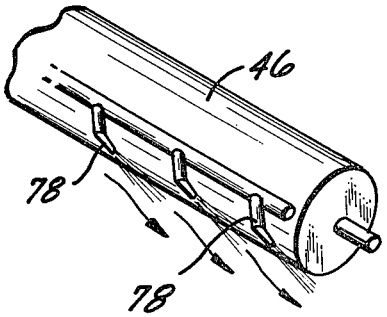
FIG. 7 is an isometric view of a portion of an alternate embodiment of the invention.

An alternate embodiment of the wave direction changing means is shown in FIG. 7. In this embodiment, in place of the vanes 54, low pressure blasts of fluid, preferably air or water, are directed toward one side in front of the roller 46. In this embodiment nozzle 78 directed toward one end of the roller 46 imparts a transverse momentum to the wave of water collected in front of the roller 46. The nozzle 78 would be connected to a suitable source of fluid at greater than atmospheric pressure. This source could be from the vehicle pulling the trailer 12, i.e. some sort of a compression apparatus powered either by the motor of the vehicle or the movement of the vehicle, the source could be from a compressor mounted on top of the trailer 12 or preferably a drive belt could link either one of the rollers 46 or an auxiliary wheel being rotated by movement of the trailer 12 to a suitable compressor. In any event whatever the source of supply of the compressed air it is simply directed in front of the roller 46 to one side.

Figure 10:
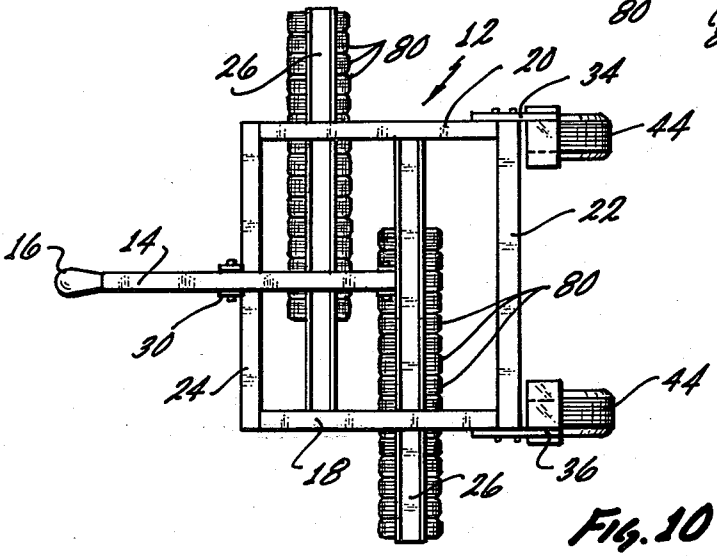
FIG. 10 is a top plan view of the embodiment of FIG. 8.

As an alternate embodiment of the monolithic roller 46 described above, a unitized roller seen in FIGS. 9 and 10 could be used. The simplest form of a unitized roller would simply be a series of disks collectively identified by the numeral 80 appropriately mounted one next to the other on a continuous axle 82. This series of disks would be shaped and sized such that they had a flat cylindrical surface which made a ninety degree angle to a flat side wall. This would allow arranging such disks one next to the other to form an almost smooth surface. Alternately standard treaded tires could also be used. With such use of standard treaded tires the seal between such tires and the surface on which the water is being removed, of course, would not be as complete as with either the roller 46 or the disk 80 described above. If use was made of standard tires a multiple roller assembly such as that shown in FIG. 6 would be preferred so that subsequent rollers could interact with water left by previous rollers. With the use of any kind of treaded rollers, whether it be a series of tires or simply a treaded surface formed on roller 46, use of the spray collecting apparatus 62 is preferred in that the tread on such a roller could tend to produce a greater amount of spray than would a smooth surfaced roller.

With all of the embodiments illustrated herein the wave of water is always maintained below the trailer 12. Movement of the roller 46 imparts a forward momentum to this wave and in the one embodiment a certain portion of this momentum is redirected sideways while in another embodiment the sideways momentum is imparted to the wave through fluid pressure. In any event, no attempt is made to lift the wave of water up above the surface on which it rests. This is totally contrary to prior apparatuses which essentially do this by vacuum pressure or by the utilization of sponges and the like. Expenditure of the energy necessary to create a vacuum is not needed since the apparatus of this invention does not physically lift the water from a surface and deposit said water in a storage tank.

I claim:

1. An apparatus for removing standing water from a large surface area which comprises:

a housing capable of being moved across said surface area;

an elongated rolling means rotatably mounted on said housing with the elongated axis of said rolling means transverse to the direction of movement of said housing on said surface area and including at least a portion of said rolling means located on the underside of said housing, said rolling means having an essentially nonwater absorbant, wear resistant surface, said portion of said rolling means located on the underside of said housing contacting a portion of said surface area and rolling on said surface area as said housing moves across said surface area, said rolling means capable of displacing water on said surface area to a position in front of said rolling means and in so doing imparting a momentum to said water and forming a moving wave of water in front of said rolling means as said rolling means moves across said surface area;

wave direction changing means located on the underside of said housing in front, with respect to the direction of travel of said housing, of said portion of said rolling means located on the underside of said housing and associated with at least that portion of said rolling means located on the underside of said housing, said wave direction changing means capable of interaction with said wave of water to modify the momentum of at least a portion of said wave of water, said modified momentum of said wave of water maintaining said wave of water essentially below the underside of said housing, at least a component of said modified momentum of said wave of water being directed transverse to the direction of travel of said housing toward at least one of the ends of said rolling means.

2. The apparatus of claim 1 wherein:

said wave direction changing means includes a member statically located in front of said rolling means along at least a portion of the elongated axis of said rolling means, said member capable of incrementally interacting with portions of said wave to transfer the direction of momentum of said wave such that a component of said direction of momentum which lies coaxial with the elongated axis of said rolling means is imparted to said wave.

3. The apparatus of claim 2 wherein:

said member includes a plurality of fixed vanes located in sequence adjacent to said roller, each of said plates individually shaped to bend the direction of travel of a portion of said wave as said wave moves along the surface of said plate.

4. The apparatus of claim 3 wherein:

each of plates includes at least a portion which is curved generally toward one of the ends of said rolling means.

5. The apparatus of claim 3 including:

said rolling means comprises an elongated cylindrical roller.

6. The apparatus of claim 1 wherein:

said water displacement means comprises dispensing means for dispensing a fluid under a pressure greater than atmospheric pressure toward at least a portion of said wave of water, the pressure of said fluid sufficient to interact with said wave of water in a manner to impart said momentum.

7. The apparatus of claim 1 including:

spray collection means attaching to said housing and located in back, with respect to direction of travel of said housing, of said rolling means and associated with said rolling means, said spray collection means capable of interacting with water from said surface area which has been lifted upwardly and rearwardly by the rolling motion of said rolling means on said surface area in the form of droplets or spray, said spray collection means capable of receiving and collecting impinging droplets or spray and channeling said droplets or spray downwardly and towards at least one of the ends of said rolling means and discharging said water so received onto said surface area adjacent to said one of said ends of said rolling means.

8. The apparatus of claim 7 wherein:

said spray collection means includes baffle means capable of inhibiting reflection of said droplets or said spray either back toward said rolling means or upwardly toward said housing.

9. The apparatus of claim 7 wherein:

said wave direction changing means includes a member statically located in front of said rolling means along at least a portion of the elongated axis of said rolling means, said member capable of incrementally interacting with portions of said wave to transfer the direction of momentum of said wave such that a component of said direction of momentum which lies coaxial with the elongated axis of said rolling means is imparted to said wave.

10. The apparatus of claim 9 wherein:

said member includes a plurality of fixed vanes located in sequence adjacent to said roller, each of said plates individually shaped to bend the direction of travel of a portion of said wave as said wave moves along the surface of said plate;

each of said plates includes at least a portion which is curved generally toward one of the ends of said rolling means.

11. The apparatus of claim 10 wherein:

said spray collection means includes baffle means capable of inhibiting reflection of said droplet or said spray either back toward said rolling means or upwardly toward said housing;

said housing includes at least one wheel pivotally mounted to said housing and capable of moving between at least a first position and a second position;

said housing includes at least one support member which in combination with said wheel being in one of said first or second positions is capable of supporting said housing above said surface area such that said rolling means does not contact said surface area and in combination with said wheel being in the other of said first or said second positions is capable of positioning said housing above said surface area such that said rolling means contacts said surface area and said housing is supported above said surface area by the combination of said rolling means and said support member.

12. The apparatus of claim 1 wherein:

said housing includes at least one wheel pivotally mounted to said housing and capable of moving between at least a first position and a second position;

said housing includes at least one support member which in combination with said wheel being in one of said first or said second positions is capable of supporting said housing above said surface area such that said rolling means does not contact said surface area and in combination with said wheel being in the other of said first or said second positions is capable of positioning said housing above said surface area such that said rolling means contacts said surface area and said housing is supported above said surface area by the combination of said rolling means and said support member.

13. The apparatus of claim 12 including:

an air foil means located on said housing and displayed upwardly with respect to said roller means in a position wherein said air foil means is free to contact air as said housing is moved across said surface area and said air foil means is capable of interacting with said air to impart a downward force on said housing and increase the effective downward force of said rolling means on said surface area.

14. The apparatus of claim 1 wherein:

said rolling means comprises a plurality of circular rollers mounted in a sequence one next to the other along the underside of said housing and together said plurality of rollers forming an elongated cylindrical roller having a plurality of discontinuities located axially along its length.

15. An apparatus for removing surface water from a large surface area which comprises:

a housing capable of being moved across said surface area;

at least two independent rolling means each rotatably mounted on the underside of said housing with the elongated axis of each of said rolling means transverse to the direction of movement of said housing on said surface area, one of said rolling means being displaced ahead of the other of said rolling means with respect to the direction of movement of said housing on said surface area, said one of said rolling means having one of its ends positioned intermediate one of the ends of the other of said rolling means and the center, as measured axially, of the other of said rolling means, each of said rolling means capable of contacting a portion of said surface area and rolling on said surface area as said housing moves across said surface area, each of said rolling means capable of displacing water on said surface area to a position in front of each of said rolling means respectively to form a moving wave of water in front of each of said rolling means respectively as said rolling means move across the surface area and at least a portion of said wave of water being directed off of said one of said ends of said rolling means displaced ahead of the other of said rolling means and being positioned to be within the pathway of said other of said rolling means;

water displacement means located on the underside of said housing in front, with respect to the direction of travel of said housing, of each of said rolling means and associated with each of said rolling means, each of said water displacement means capable of interacting with said wave of water in front of each of said roller means to impart a momentum to at least a portion of said wave of said water, at least a component of said momentum being transverse to the direction of travel of said housing towards at least one of the ends of one of said rolling means.

* * * * *

UNITED STATES PATENT AND TRADEMARK OFFICE

CERTIFICATE OF CORRECTION

PATENT NO. : 4,356,584

DATED : NOVEMBER 2, 1982

INVENTOR(S) : RICHARD F. ZAMBONI

It is certified that error appears in the above-identified patent and that said Letters Patent is hereby corrected as shown below:

Column 1, lines 44 and 45, "the artificial" should read --the artificial surface--.

Column 6, line 20, "of a" should read --or a--.

Column 13, lines 33 and 34, Claim 13, "displayed" should read --displaced--.

Signed and Sealed this

*Twenty-first* Day of *June 1983*

[SEAL]

*Attest:*

DONALD J. QUIGG

*Attesting Officer*

*Acting Commissioner of Patents and Trademarks*